US007342187B2

(12) United States Patent
Yamaguchi

(10) Patent No.: US 7,342,187 B2
(45) Date of Patent: Mar. 11, 2008

(54) ROTATING INPUT SELECTION DEVICE

(75) Inventor: Mitsuaru Yamaguchi, Tokyo (JP)

(73) Assignee: SMK Corporation, Tokyo (JP)

( * ) Notice: Subject to any disclaimer, the term of this patent is extended or adjusted under 35 U.S.C. 154(b) by 452 days.

(21) Appl. No.: 11/121,494

(22) Filed: May 3, 2005

(65) Prior Publication Data

US 2006/0013385 A1 Jan. 19, 2006

(30) Foreign Application Priority Data

Jul. 16, 2004 (JP) ..... 2004-209405

(51) Int. Cl.
*H01H 9/00* (2006.01)

(52) U.S. Cl. ..... 200/14; 200/4

(58) Field of Classification Search ..... 200/4, 200/5 A, 14, 11 A, 11 C, 11 TW, 11 DA, 200/336, 339, 564, 570, 17 R, 18
See application file for complete search history.

(56) References Cited

U.S. PATENT DOCUMENTS 4,087,665 A 5/1978 Tanaka
4,408,103 A * 10/1983 Smith, III ..... 200/6 A
4,970,512 A 11/1990 Wood et al.
6,262,378 B1 * 7/2001 Chou ..... 200/4
6,396,006 B1 * 5/2002 Yokoji et al. ..... 200/4
6,635,832 B1 * 10/2003 Oster et al. ..... 200/6 A
7,087,848 B1 * 8/2006 Yamasaki et al. ..... 200/6 A
7,119,290 B2 * 10/2006 Kim ..... 200/5 R
7,166,810 B2 * 1/2007 Hanahara et al. ..... 200/11 R
7,262,373 B2 * 8/2007 Miura et al. ..... 200/4

OTHER PUBLICATIONS

Patent Abstracts of Japan for JP2001-118469 published Apr. 27, 2001.
Patent Abstracts of Japan for JP03-244012 published Oct. 30, 1991.
European Search Report for EP 05 07 6068 completed Oct. 3, 2005.

* cited by examiner

*Primary Examiner*—Elvin Enad
*Assistant Examiner*—M. Fishman
(74) *Attorney, Agent, or Firm*—Darby & Darby P.C.

(57) ABSTRACT

A rotating input selection device is equipped with a rotating input unit, a case member rotatably supporting the rotating input unit, a circuit substrate opposing the rotating input unit, and a contact connection structures formed from a fixed contact point and a movable contact point. A rubber sheet, interposed between the rotating input unit and the circuit substrate, includes a tilting pressure section supported on the rotating substrate by way of a tilting support section, so that a tilting motion is possible. The contact point connection structures are disposed so that they are separated from each other and are aligned with the ends of the tilting pressure section on the circuit substrate. Rotation of the rotating input unit causes the tilting pressure section to tilt in the direction of rotation, resulting in the tilting pressure section pushing the movable contacts toward the fixed contact points.

16 Claims, 8 Drawing Sheets

ROTATING INPUT SELECTION DEVICE

INCORPORATION BY REFERENCE

The present application claims priority under 35 U.S.C. §119 to Japanese Patent Application No. 2004-209405 filed on Jul. 16, 2004. The content of the application is incorporated herein by reference in its entirety.

FIELD OF INVENTION

The present invention relates to a rotating input selection device used to operate audio or video devices, particularly portable electronic devices such as portable telephones, personal digital assistants, and the like.

BACKGROUND OF THE INVENTION

In conventional remote control devices used to remotely operate televisions and audio devices such as video decks, a rotating input selection device known as a jog dial or jog shuttle is used to improve ease of use. In recent years, these types of rotating input selection devices are also being widely used in portable electronic devices such as portable telephones.

These types of rotating input selection devices include: a disc-shaped rotating element, a case member rotatably supporting a rotating element and a circuit substrate facing the rotating element. A brush formed from a conductive material is disposed on the surface of the rotating element toward the circuit substrate and facing fixed contacts disposed on the circuit substrate. When the rotating element is rotated, the brush slides against the circuit substrate while coming into contact with the fixed contacts, forming electrical continuities (e.g., see Japanese Laid-Open patent publication number 2001-118469, or Japanese patent publication number 3049072).

In the conventional technology described above, however, water droplets and debris can enter the cover member through the space between the rotating element and the cover member, leading to malfunctions and damage and the like.

Also, in the rotating input selection device described above, the contact between the contacts on the circuit substrate and the brush, which is formed as a metal member, leads to significant wear and reduced durability.

OBJECT AND SUMMARY OF THE INVENTION

The object of the present invention is to overcome the problems of the conventional technology described above and to provide a rotating input selection device that effectively protects the circuit substrate against water droplets and debris and that provides superior durability.

In order to overcome the problems described above and to achieve the desired objects, the invention provides a rotating input selection device including: a disc-shaped rotating element with a plurality of operating projections formed on an end surface or a perimeter surface, separated by circumferential intervals; a case member rotatably supporting the rotating element; a circuit substrate disposed facing the rotating element; and contact connection structures formed from a fixed contact disposed on the circuit substrate and a movable contact facing the fixed contact; wherein the rotating element is rotated so that a connection is formed between the fixed contact and the movable contact. A rubber sheet formed from an insulative material is disposed between the rotating element and the circuit substrate. The rubber sheet includes a rubber main sheet unit and a tilting pressure section supported on the main sheet unit by a tapered cylindrical elastic support. The tilting pressure section includes: a tilting section that is supported on the main sheet body by the elastic support and is tiltably supported by the circuit substrate by a tilt support section projected integrally on the substrate side; and an operating engagement section formed integrally with the tilting section and engaging with the operating projections. The contact connection structures are positioned at intervals aligned with both ends of the tilting section on the circuit substrate. The rotating element is rotated to engage the operating projections with the operating engagement section, causing the tilting section supported on the circuit substrate by the tilt support section to tilt in a direction of rotation of the rotating element so that the tilting section pushes the movable contact positioned along the rotation direction toward the fixed contact.

In addition, the contact connection structure includes a pair of fixed contacts arranged on the substrate and a movable contact supported on both substrate-side ends of the tilting section. When the tilting section is tilted in the rotation direction, the movable contact comes into contact with and is extended across the fixed contacts.

In addition, the fixed contact and movable contact are formed from a carbon material.

In addition, the operating engagement section includes an engagement projection projecting from a center of an upper surface and engaging with the operating projections.

In addition, the operating engagement section includes an engagement cavity formed at a center of an upper surface and sloped sections sloping outward and downward from both edges of the engagement cavity.

In addition, the operating engagement section is formed as a separate unit from the tilting section.

In addition, the rotating element is supported by the case member by a pivoting case pivotably supported on the case member. Push-type switches are disposed at a plurality of positions facing a perimeter edge on a back surface of the rotating element of the circuit substrate. The push-type switches are switched by the pivoting case by pushing a front surface of the rotating element.

In addition, the rubber sheet is formed integral with a keyboard sheet including a key top section supported by a tapered cylindrical restoring elastic section.

The rotating input selection device according to one embodiment includes: a disc-shaped rotating element with a plurality of operating projections formed on an end surface or a perimeter surface, separated by circumferential intervals; a case member rotatably supporting the rotating element; a circuit substrate disposed facing the rotating element; and contact connection structures formed from a fixed contact disposed on the circuit substrate and a movable contact facing the fixed contact; wherein the rotating element is rotated so that a connection is formed between the fixed contact and the movable contact. By including a rubber sheet formed from an insulative material between the rotating element and the circuit substrate, the circuit substrate can be protected from water droplets and debris entering the case member from gaps, thus effectively preventing malfunctions and damage.

The rubber sheet includes a rubber main sheet unit and a tilting pressure section supported on the main sheet unit by a tapered cylindrical elastic support. The tilting pressure section includes: a tilting section that is supported on the main sheet body by the elastic support and is tiltably supported by the circuit substrate by a tilt support section projected integrally on the substrate side; and an operating engagement section formed integrally with the tilting section and engaging with the operating projections. The contact connection structures are positioned at intervals aligned with both ends of the tilting section on the circuit substrate. The rotating element is rotated to engage the operating projections with the operating engagement section, causing the tilting section supported on the circuit substrate by the tilt support section to tilt in a direction of rotation of the rotating element so that the tilting section pushes the movable contact positioned along the rotation direction toward the fixed contact. As a result, superior input operations can be performed even with the presence of the rubber sheet between the rotating element and the circuit substrate. Furthermore, when tilting takes place, a desirable clicking feedback is provided.

The contact connection structure includes a pair of fixed contacts arranged on the substrate and a movable contact supported on both substrate-side ends of the tilting section. When the tilting section is tilted in the rotation direction, the movable contact comes into contact with and is extended across the fixed contacts. As a result, the contacts can connected effectively. Also, since there is no sliding, wear is avoided and durability is improved.

The fixed contact and movable contact are formed from a carbon material. As a result, durability is improved.

The operating engagement section includes an engagement projection projecting from a center of an upper surface and engaging with the operating projections. As a result, engagement with the operating projection can take place effectively and input operations can be performed reliably.

The operating engagement section includes an engagement cavity formed at a center of an upper surface and sloped sections sloping outward and downward from both edges of the engagement cavity. As a result, engagement with the operating projection can take place effectively and input operations can be performed reliably.

The operating engagement section is formed as a separate unit from the tilting section. As a result, the shape of the operating engagement section can be selected to suit the application.

The rotating element is supported by the case member by a pivoting case pivotably supported on the case member. Push-type switches are disposed at a plurality of positions facing a perimeter edge on a back surface of the rotating element of the circuit substrate. The push-type switches are switched by the pivoting case by pushing a front surface of the rotating element. As a result, both multi-directional input functions and rotating input functions can be provided, resulting in a high degree of usefulness in input operations.

The rubber sheet is formed integral with a keyboard sheet including a key top section supported by a tapered cylindrical restoring elastic section. As a result, costs can be lowered.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 6(*b*) is a bottom-view drawing of the device shown in FIG. 6(*a*);

FIG. 6(*c*) is a cross-section drawing of the device shown in FIG. 6(*a*);

FIG. 8(*b*) is a bottom-view drawing of the device shown in FIG. 8(*a*);

FIG. 8(*c*) is a drawing along the B-B line of FIG. 8(*a*).

DETAILED DESCRIPTION OF THE PREFERRED EMBODIMENTS

Figure 1:
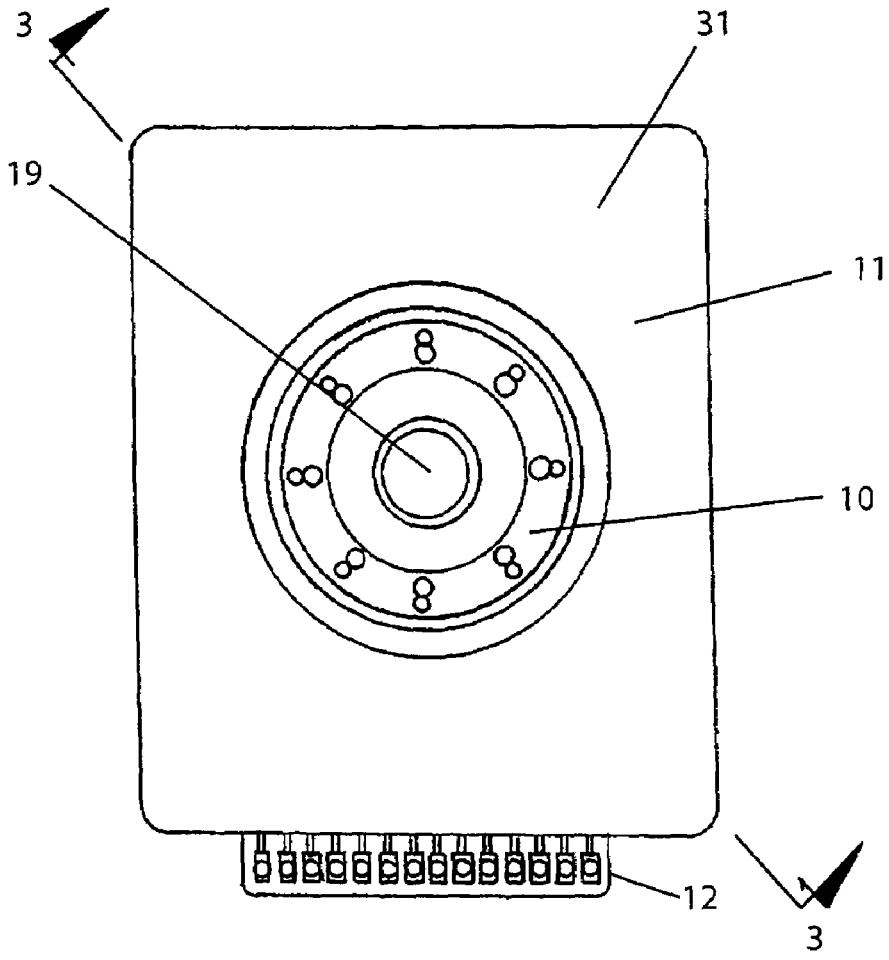
FIG. 1 is a plan drawing of an embodiment of a rotating input selection device according to the present invention.
Figure 2:
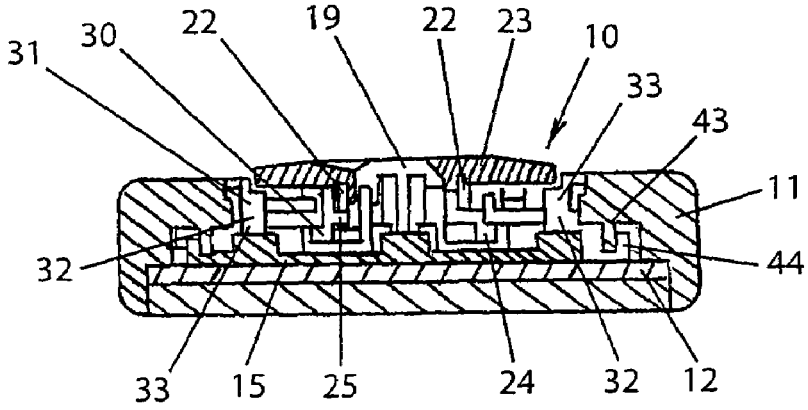
FIG. 2 is a cross-section drawing of the device shown in FIG. 1.
Figure 3:
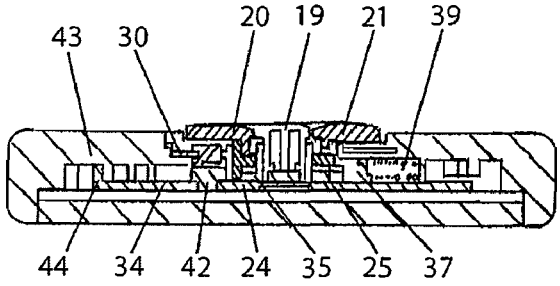
FIG. 3 is a drawing along the A-A line of FIG. 1.
Figure 4:
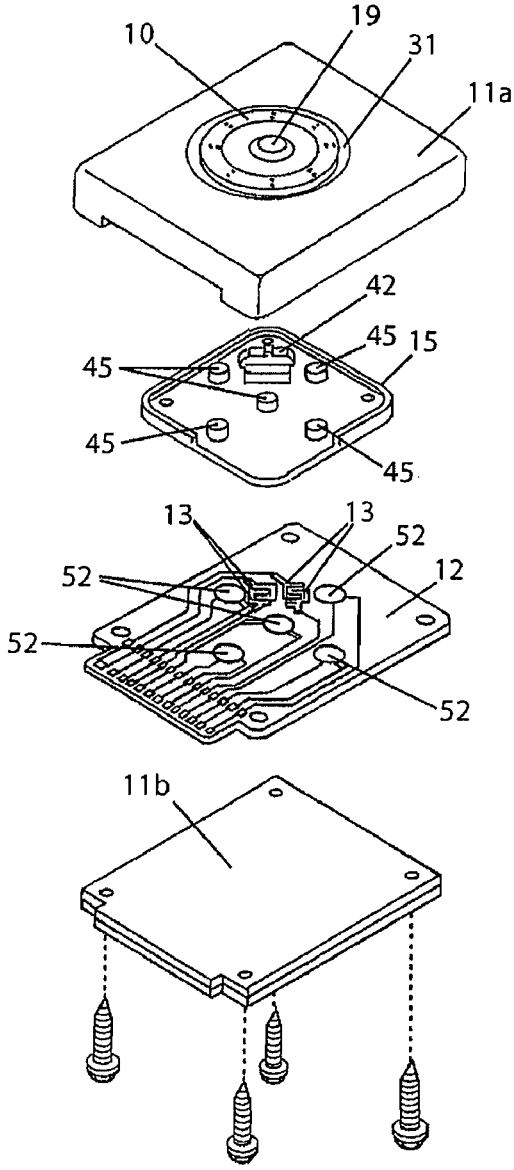
FIG. 4 is an exploded perspective drawing of the device shown in FIG. 1.

Next, a rotating input selection device according to the present invention will be described.

FIG. 1 through FIG. 4 show one example of a rotating input selection device.

This rotating input selection device includes: a disc-shaped rotating element 10; a case member 11 rotatably supporting the rotating element 10; a circuit substrate 12 facing the rotating element 10; and a contact connection structure, formed from fixed contacts 13, 13 disposed on the circuit substrate 12 and movable contacts 14, facing the fixed contacts 13.

In one embodiment of the rotating input selection device, a rubber sheet 15 formed from an insulative material is disposed between the rotating element 10 and the circuit substrate 12, protecting the circuit substrate 12 from water droplets, debris, and the like.

Figure 5:
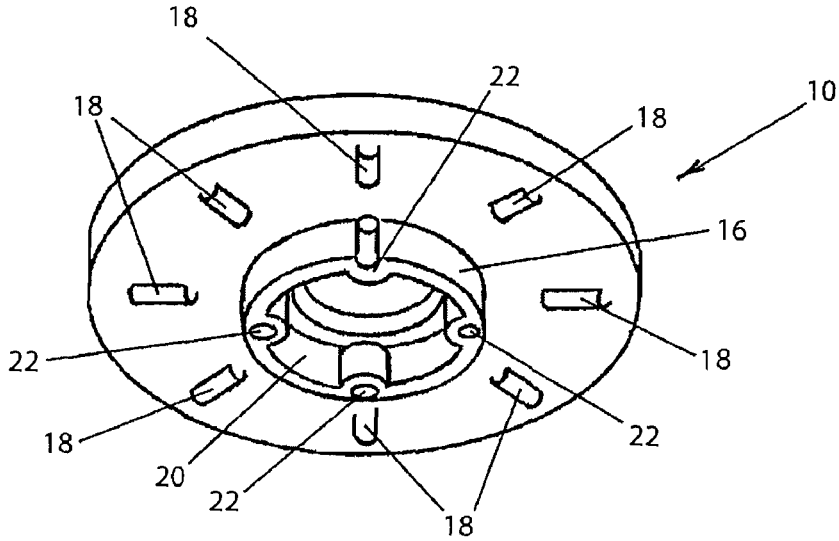
FIG. 5 is a perspective drawing showing a rotating element of the device shown in FIG. 1.
Figure 7:
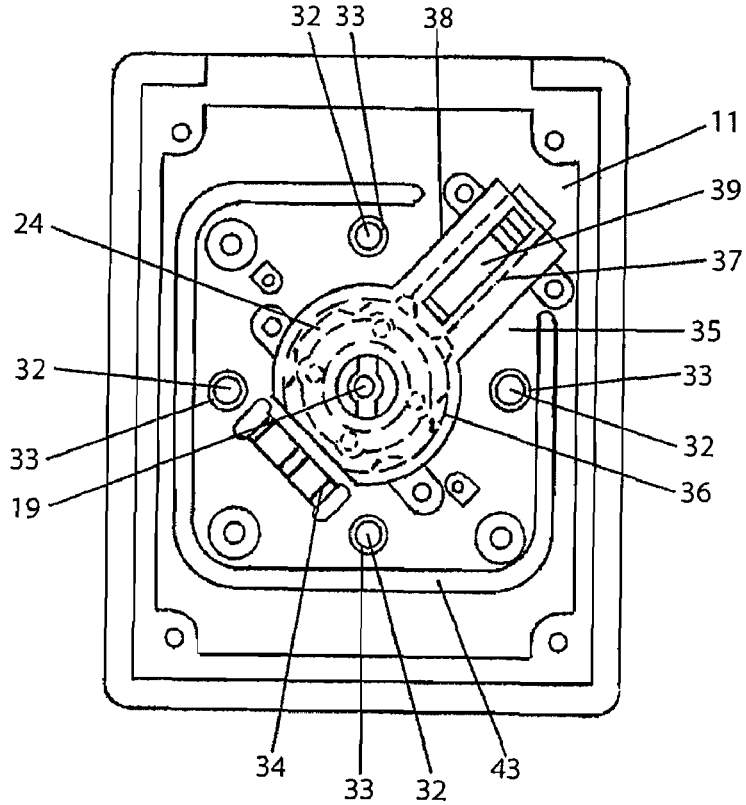
FIG. 7 is a bottom-view drawing showing the rotating element installed in the case member of the device shown in FIG. 1.

As shown in FIG. 5, the rotating element 10 is formed as a disc that includes a cylindrical section 16 projecting integrally from the center of the bottom surface. The cylindrical section 16 is prevented from slipping out from the case member 11 by a slip-prevention member 17, which is removably attached to the cylindrical section 16.

On the bottom surface of the rotating element 10 (the side facing the substrate), multiple operating projections 18 are projected radially, separated by circumferential distances. The movable contact 14 and the fixed contact 13 are connected by the operating projections 18, and the number of the operating projections 18 determine the number of inputs that take place when the rotating element 10 is rotated once.

Also, at the center of the rotating element 10, there is formed a key exposure hole 20, from the surface of which is exposed the key top of a push-type key switch 19 disposed in the cylindrical section 16.

Figure 6A:
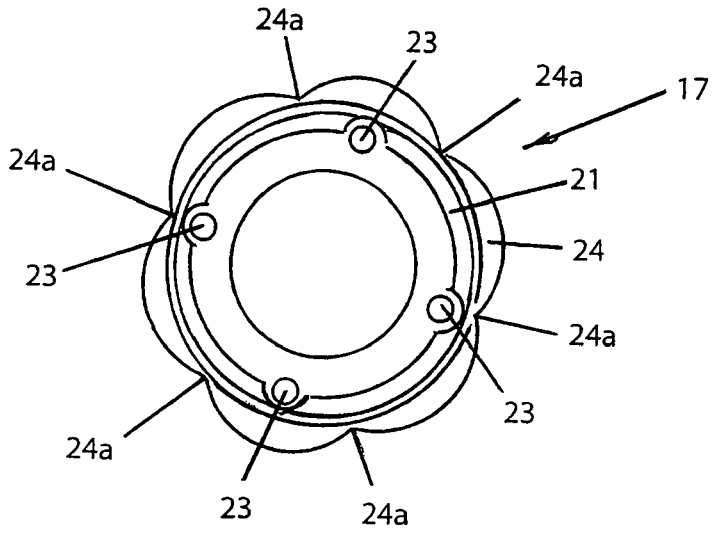
FIG. 6(*a*) is a plan drawing showing a slippage prevention member of the device shown in FIG. 1.
Figure 6B:
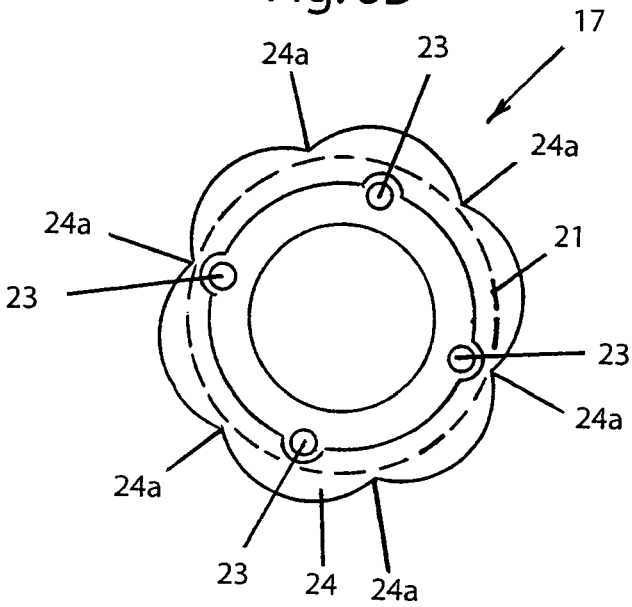
Figure 6C:
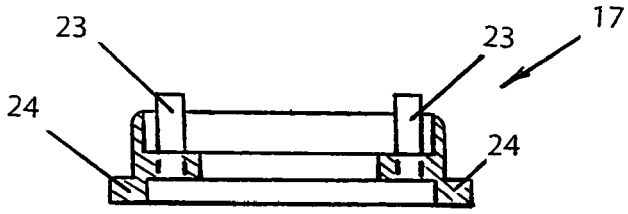

As shown in FIG. 6, the slip-prevention member 17 integrally includes: a ring-shaped shaft 21; attachment pins 23 that fit into attachment holes, or depressions, 22 formed on the cylindrical section 16; and a flange 24 outwardly projecting from the outer edge of the shaft 21.

The shaft 21 is supported by a bearing hole 25 formed on the case member 11, allowing the rotating element 10 to be rotatably supported by the case member 11.

The flange 24, formed with cavities 24*a* that are smoothly continuous with the outer perimeter, is disposed on the back side of the bearing hole 25, preventing the rotating element 10 from slipping out from the case member 11.

The case member 11 includes: a main case unit 11*a* with an attachment cavity 30 formed on the surface thereof into which the rotating element 10 is fitted; and a pushing section 11*b* secured to the main case unit 11*a*. The rubber sheet 15 placed over the back surface of the attachment cavity 30 and the circuit substrate 12 are placed in the main case unit 11*a*, and this is supported by the pushing section 11*b*. The shape taken by the case member is not restricted to the shape presented in the embodiments or the figures. A shape suited to the device (e.g., a remote control or a portable telephone) in which the rotating input selection device of the present invention is installed is used.

A ring-shaped pivoting case 31 is pivotably fitted to the outer perimeter section of the attachment cavity 30, and the outer perimeter edge of the rotating element 10 is supported by the upper edge of the pivoting case 31. The rotating element 10 is pivotably supported by the case member 11 by way of the pivoting case 31.

A support projection 32 is integrally projected from a predetermined position on the back surface of the pivoting case 31. This support projection 32 is projected to the back surface side through an insertion hole 33 formed on the bottom surface of the attachment cavity 30.

At the bottom center of the attachment cavity 30 is formed a bearing hole 25 surrounded by a perimeter wall projected from the surface. The rotating element 10 is supported by this bearing hole 25.

A projecting window 34, through the front side (toward the rotating element 10) of which is projected a tilting push section 42, described later, is disposed on the bottom surface of the attachment cavity 30 at a position facing the back surface of the rotating element 10. Insertion holes 33 for insertion of the support projections 32 are formed at positions facing the pivoting case 31.

A holder 35 covering the flange 24 of the slippage prevention member 17 is formed on the back side of the bottom of the attachment cavity 30.

The holder 35 includes a main holder unit 36 covering the flange 24 and a slide support section 38 slidably supporting a slider 37.

The slider 37 is biased into the main holder unit 36 by a coil spring 39. The end of the circular slider 37 is fitted against a cavity 24*b* of the flange 24 by the strength of the spring 39. As a result, the flange 24 always stops at a predetermined angle. In other words, the rotating element 10 stops at a predetermined angle.

Figure 8A:
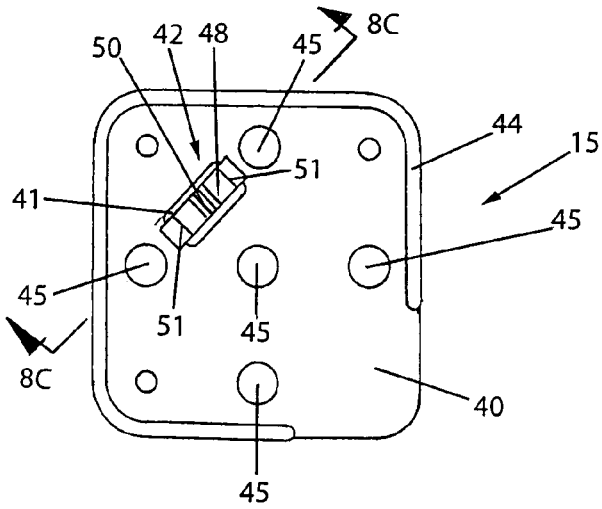
FIG. 8(*a*) is a plan drawing showing a rubber sheet of the device shown in FIG. 1.
Figure 8B:
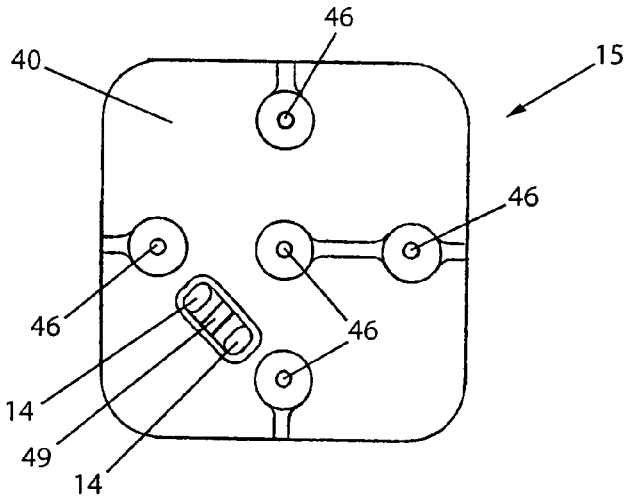
Figure 8C:
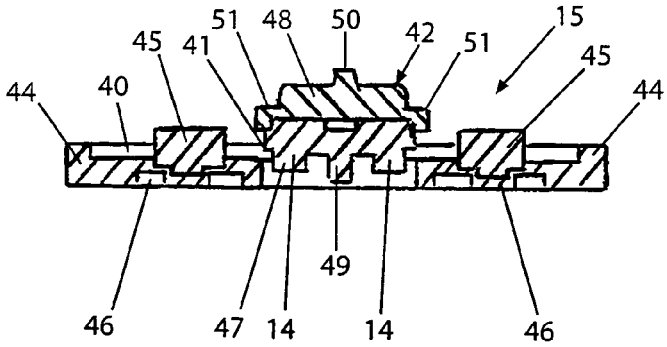

As shown in FIG. 8, the rubber sheet 15 includes: a rubber main sheet unit 40; and the tilting pressing section 42 supported by way of an elastic support section 41. When the rubber sheet 15 is aligned and placed against the back surface of attachment cavity 30, a section of the tilting pressing section 42 is projected toward the rotating element 10 and engages with the rotating element 10.

At the perimeter edge of the main sheet unit 40 is integrally projected a perimeter wall 44 that fits against a raised wall 43 of the case member 11.

Cylindrical elastic pushing sections 45 are formed on the main sheet unit 40 and are projected toward the rotating element 10 at positions aligned with the positions of the push-type key switch 19 and the supporting projection 32 of the pivoting case 31. The pivoting case 31 and the push-type key switch 19 are biased toward the front by the elasticity of the pushing sections 45.

A contact 46 is integrally formed at the center of a circular cavity on the side of the elastic pushing section 45 toward the back side of the sheet. This allows the center of the push-type switch disposed over the circuit substrate 12 to be pushed effectively against the contact 46.

The tilting push section 42 is disposed on the main sheet unit 40 at a position facing the rotating element 10 and is oriented so that its longer axis is perpendicular to the radial direction.

This tilting push section 42 includes: a tilting section 47 supported by the main sheet unit 40 by way of the elastic support section 41; and an operating engagement section 48 engaging with a operating projection 18 of the rotating element 10.

The tilting section 47 is supported by the main sheet unit 40 by way of the elastic supported section 41, which is formed as a tapered cylinder, and is formed integrally with a tilting support section 49 projecting downward from the center (toward the substrate).

This tilting section 47 is supported by the circuit substrate 12 by way of the tilting support section 49 and tilts around the end of the tilting support section 49.

The movable contacts 14, formed from a conductive material such as carbon, are formed at the bottom (toward the substrate) of the two ends of the tilting section 47.

The operating engagement section 48 is formed from a synthetic resin as a box in a shape corresponding to that of the tilting section 47, and at the center of the upper surface thereof there is integrally formed an engagement projection 50 that engages with the operating projection 18 of the rotating element 10.

Shelves 51 fit against the edge of the projected window 34 and are formed at the ends of the operating engagement section 48.

The tilting section 47 and the operating engagement section 48 are integrated by adhering together the bottom surface of the operating engagement section 48 and the upper surface of the tilting section 47. The tilting section 47 can be tilted by turning the rotating element 10 and engaging the operating projection 18 with the engagement projection 50.

Figure 9:
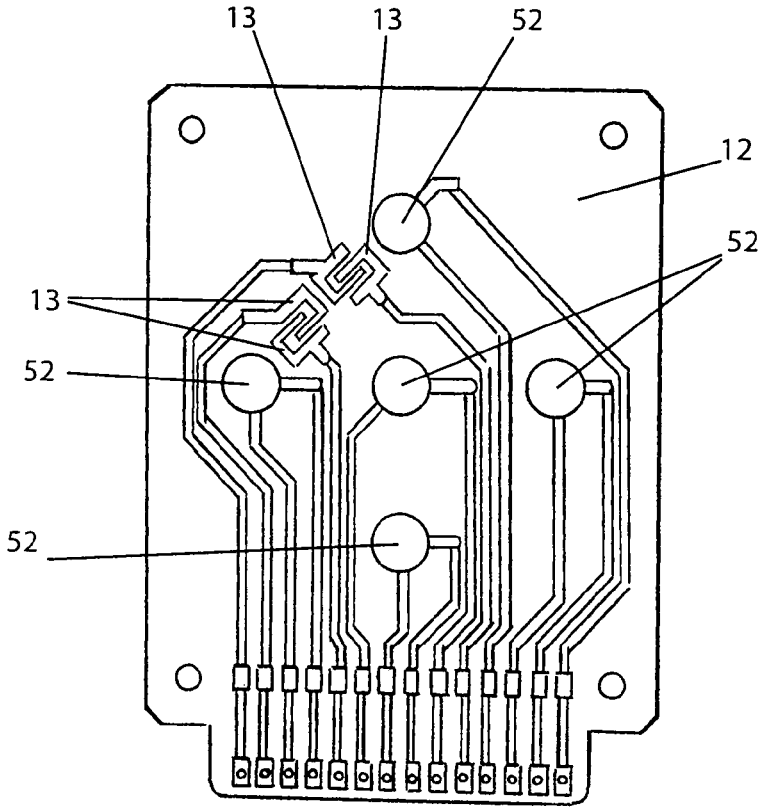
FIG. 9 is a plan drawing of a circuit substrate of the device shown in FIG. 1.

As shown in FIG. 9, push-type switches 52 are disposed at predetermined positions on the circuit substrate 12. When the surface of the cylindrical section 16 of the rotating element 10 is pressed, the rotating element 10 pivots, and the support projection 32 pushes, in the direction of pivoting, the push-type switch 52 by way of the elastic push section 45 of the rubber sheet 15, thus activating the switch. When the key top of the push-type key switch 19 is pressed, the push-type switch 52 is pressed by way of the elastic push section 45 of the rubber sheet 15, thus activating the switch.

The circuit substrate 12 also includes two sets of contacts formed from a pair of fixed contacts 13, 13 positioned in alignment with the ends of the tilting push section 42, i.e., the positions of the movable contacts 14.

These fixed contacts 13, 13 are disposed so that they form square "C" shapes and mesh against each other.

Compared to metal contacts, the use of carbon in the fixed contacts 13 and the movable contacts 14 can increase longevity. When metal contacts are used, they tend to wear and their input lifespan is 50,000-100,000 rotations. If carbon is used, the contacts have greater durability and provide a lifespan of (1,000,000 to 10,000,000/(number of projections)) rotations.

Figure 10A:
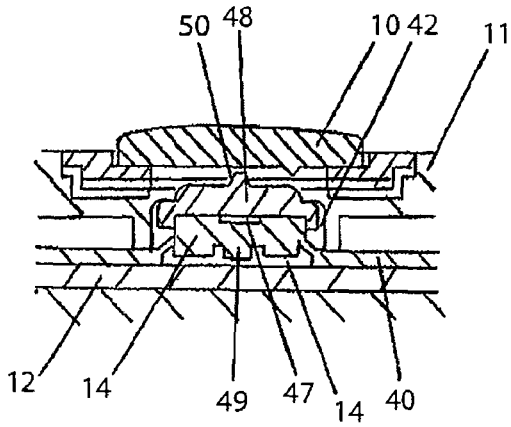
FIG. 10 is a cross-section drawing illustrating the operation of the device shown in FIG. 1.
Figure 10B:
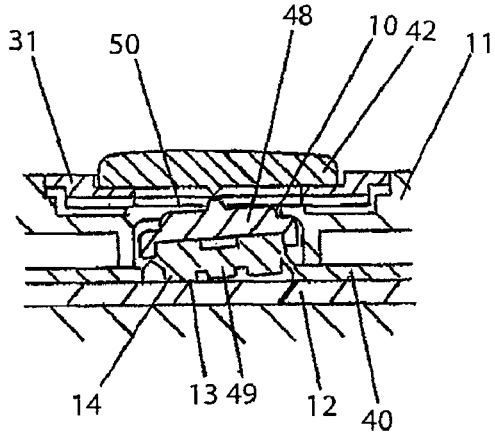
Figure 10C:
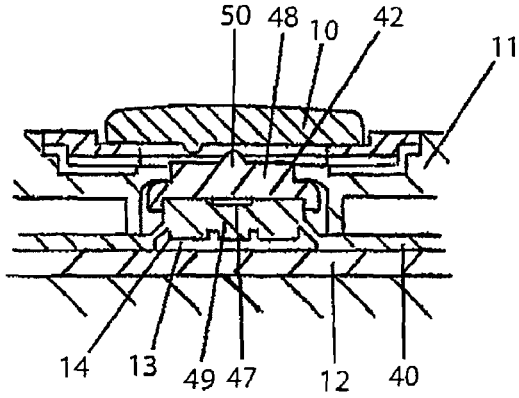

As shown in FIG. 10(*a*)-FIG. 10(*b*), when the rotating element 10 of this rotating input selection device is rotated, the operating projection 18 on the back surface of the rotating plate engages with the operating engagement section 48 of the tilting pushing section 42 at the center, i.e., with the engagement projection 50. When further rotation is applied, the operating projection 18 pushes the operating engagement section 48 and the tilting section 47 integral with the operating engagement section 48 tilts in the direction of rotation with the end of the tilting support section as the pivot.

As a result, the movable contact 14 on the side of the tilting section 47 toward the substrate is extended across the pair of fixed contacts 13 on the circuit substrate 12, forming electrical continuity.

As shown in FIG. 10 (*b*)-FIG. 10 (*c*), when the rotating element 10 is further rotated, the operating projection 18 rides over the engagement projection 50 of the operating engagement section 48 so that the tilting pressure section 42 is restored to a neutral position by the elasticity of the elastic support section 41.

Figure 11:
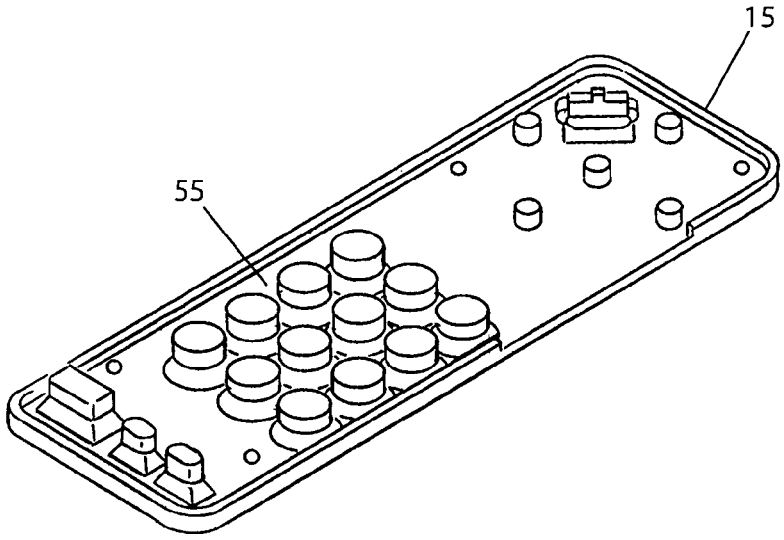
FIG. 11 is a perspective drawing showing another embodiment of the rubber sheet of the device shown in FIG. 1.

In the example in the embodiment described above, the rubber sheet 15 is used by itself. However, as shown in FIG. 11, it would also be possible to use the rubber sheet 15 integrally with a keyboard sheet 55 formed with keyboard switches.

Figure 12:
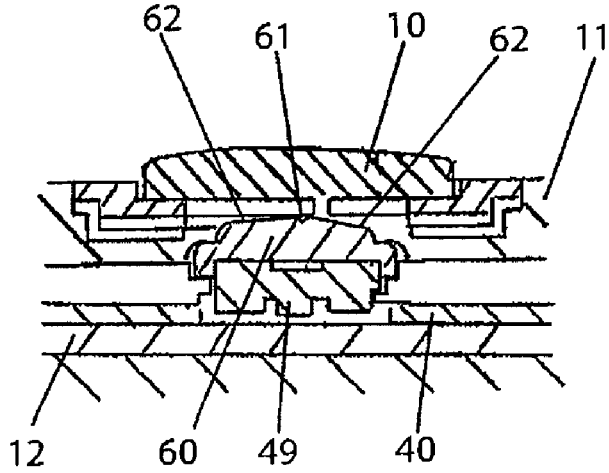
FIG. 12 is a cross-section drawing of an embodiment of a tilting pushing section of the device shown in FIG. 1.

Also, besides what is described above, an operating engagement section 60 can also include, as shown in FIG. 12, an engagement cavity 61 formed at the center of the upper surface, and sloped sections 62 sloped outward and downward from the two edges of the engagement cavity 61. In this case, when the rotating element 10 is rotated, the operating projection 18 engages with the sloped section 62, tilting the tilting section 47 in the direction of rotation. Further rotation causes the operating projection 18 to fit in the engagement cavity 61, so that the neutral position is restored. With further rotation, the operating projection 18 engages with the edge of the engagement cavity 61, tilting the tilting section 47 in the rotation direction again, followed by the operating projection 18 moving away from the operating engagement section 60 and the tilting pushing section 42 being restored to its neutral position.

Also, the operating engagement section can be formed integrally with the engagement section.

Figure 13:
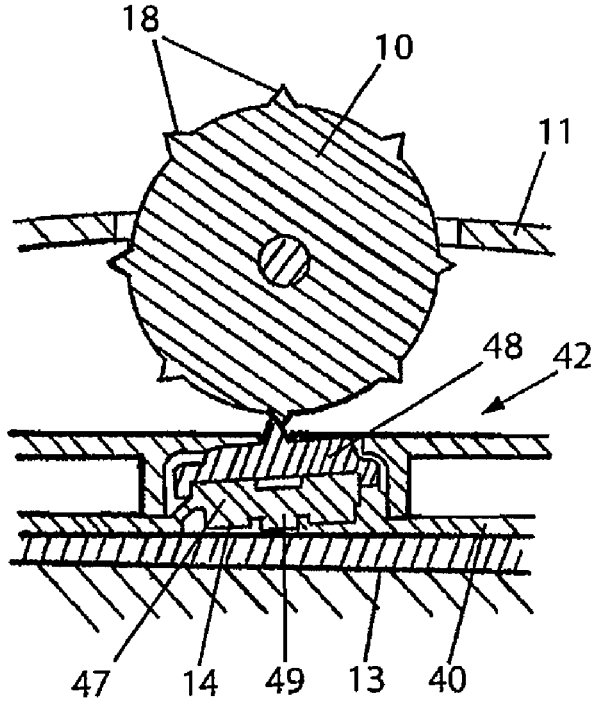
FIG. 13 is a cross-section drawing showing another embodiment of a rotating input selection device according to the present invention.

In the embodiment described above, the rotating element 10 and the circuit substrate 12 are parallel to each other. However, as shown in FIG. 13, the rotating element 10 can also be perpendicular to the circuit substrate 12. In such cases, the operating projections 18 are formed at intervals along the outer perimeter surface of the rotating element 10.

In the embodiment described above, the example above also serves as a multi-directional input device, but it would also be possible to use it just as a rotating input selection device.

The rotating input selection device of the present invention can be used as the input system in audio devices such as televisions and video decks, portable electronic devices such as remote control devices and portable telephones, and the like.

Thus, while there have been shown, described, and pointed out fundamental novel features of the invention as applied to several embodiments, it will be understood that various omissions, substitutions, and changes in the form and details of the illustrated embodiments, and in their operation, may be made by those skilled in the art without departing from the spirit and scope of the invention. Substitutions of elements from one described embodiment to another are also fully intended and contemplated. The invention is defined solely with regard to the claims appended hereto, and equivalents of the recitations therein.

I claim:

1. A rotating input selection device comprising:

a disc-shaped rotating element having a plurality of operating projections formed on one of an end surface and a perimeter surface, wherein the plurality of operating projections are separated by circumferential intervals;

a case member rotatably supporting said rotating element;

a circuit substrate, disposed facing said rotating element, including fixed contact connection structures;

a movable contact element opposing said fixed contact, wherein rotation of said rotating element forms a connection between said fixed contact connection structures and said movable contact;

a rubber sheet formed from an insulative material disposed between said rotating element and said circuit substrate;

said rubber sheet including a rubber main sheet unit and a tilting pressure section supported on said main sheet unit by a tapered cylindrical elastic support;

said tilting pressure section including a tilting section, having ends, and supported on the main sheet body by said elastic support, wherein the tilting section is tiltably supported by a tilt support section projected integrally from a side of the tilting section; and an operating engagement section formed integrally with said tilting section and engaging the plurality of operating projections;

wherein said contact connection structures are positioned at intervals aligned with each end of said tilting section on said circuit substrate, and wherein said rotating element is rotated to engage said operating projections with said operating engagement section, causing said tilting section supported on said circuit substrate by said tilt support section to tilt in a direction of rotation of said rotating element so that said tilting section pushes said movable contact positioned along said rotation direction toward said fixed contact.

2. The rotating input selection device as described in claim 1, wherein the contact connection structure further comprises:

a pair of fixed contacts arranged on said substrate; and a movable contact supported on both substrate-side ends of said tilting section;

wherein, when said tilting section is tilted in said rotation direction, said movable contact comes into contact with, and is extended across, said fixed contacts.

3. The rotating input selection device as described in claim 1, wherein the fixed contact and the movable contact are formed from a carbon material.

4. The rotating input selection device as described in claim 1, wherein the operating engagement section further comprises an engagement projection projecting from a center of an upper surface of the operating engagement section, and engaging with the plurality of operating projections.

5. The rotating input selection device as described in claim 1, wherein the operating engagement section further comprises:

an engagement cavity formed at a center of an upper surface of the operating engagement section; and sloped sections sloping outward and downward from both edges of said engagement cavity.

6. The rotating input selection device as described in claim 1, wherein said operating engagement section is formed as a separate unit from said tilting section.

7. The rotating input selection device as described in claim 1, further comprising:

a pivoting case, pivotably supported on said case member, that supports said rotating element; and push-type switches disposed at a plurality of positions opposing a perimeter edge on a back surface of said rotating element of said circuit substrate;

wherein said push-type switches are switched by said pivoting case by pushing a front surface of said rotating element.

8. The rotating input selection device as described in claim 1, wherein said rubber sheet is formed integral with a keyboard sheet including a key top section supported by a tapered cylindrical restoring elastic section.

9. A rotating input selection device comprising:

a rubber sheet formed from an insulative material disposed between a rotating element and a circuit substrate, wherein a case member rotatably supports the rotating element, and wherein the circuit substrate is disposed opposing the rotating element;

said rubber sheet including a rubber main sheet unit and a tilting pressure section supported on said main sheet unit by a tapered cylindrical elastic support;

said tilting pressure section including a tilting section supported on the main sheet body by said elastic support, wherein the tilting section is tiltably supported by a tilt support section projected integrally from a side of the tilting section; and an operating engagement section formed integrally with said tilting section and engaging a plurality of operating projections formed on the rotating element.

10. The rotating input selection device as described in claim 9, further comprising:

a pair of fixed contacts arranged on said substrate; and a movable contact supported on both substrate-side ends of said tilting section;

wherein, when said tilting section is tilted in said rotation direction, said movable contact comes into contact with, and is extended across, said fixed contacts.

11. The rotating input selection device as described in claim 10, wherein the fixed contact and the movable contact are formed from a carbon material.

12. The rotating input selection device as described in claim 9, wherein the operating engagement section further comprises an engagement projection projecting from a center of an upper surface of the operating engagement section, and engaging with the plurality of operating projections.

13. The rotating input selection device as described in claim 9, wherein the operating engagement section further comprises:

an engagement cavity formed at a center of an upper surface of the operating engagement section; and sloped sections sloping outward and downward from both edges of said engagement cavity.

14. The rotating input selection device as described in claim 9, wherein said operating engagement section is formed as a separate unit from said tilting section.

15. The rotating input selection device as described in claim 9, further comprising:

a pivoting case, pivotably supported on said case member, that supports said rotating element; and push-type switches disposed at a plurality of positions opposing a perimeter edge on a back surface of said rotating element of said circuit substrate;

wherein said push-type switches are switched by said pivoting case by pushing a front surface of said rotating element.

16. The rotating input selection device as described in claim 9, wherein said rubber sheet is formed integral with a keyboard sheet including a key top section supported by a tapered cylindrical restoring elastic section.

* * * * *